US005769173A

United States Patent [19]

Egami et al.

[11] Patent Number: 5,769,173

[45] Date of Patent: Jun. 23, 1998

[54] VIBRATION EXCITER MACHINE

[75] Inventors: Noritaka Egami; Shinichi Hattori; Ryosuke Taniguchi; Takahiro Sakamoto; Takashi Shimada, all of Nagasaki, Japan

[73] Assignee: Mitsubishi Denki Kabushiki Kaisha, Tokyo, Japan

[21] Appl. No.: 539,527

[22] Filed: Oct. 6, 1995

[30] Foreign Application Priority Data

Jun. 10, 1995 [JP] Japan ..... 7-168051

[51] Int. Cl.[6] ..... E21D 20/00

[52] U.S. Cl. ..... 173/114; 173/49; 173/117; 173/217; 175/19; 405/232

[58] Field of Search ..... 173/49, 217, 112, 173/114, 117; 175/19; 405/231, 232

[56] References Cited

U.S. PATENT DOCUMENTS 4,033,419 7/1977 Pennington ..... 173/39

5,366,026 11/1994 Maruyama et al. ..... 173/181

FOREIGN PATENT DOCUMENTS 47-15946 8/1972 Japan .

*Primary Examiner*—Scott A. Smith

*Attorney, Agent, or Firm*—Burns, Doane, Swecker & Mathis, LLP

[57] ABSTRACT

A vibration exciter machine has magneto striction elements (5,6) supported by a driven pile (2), for providing a vibration of up and down direction to the driven pile (2), and a drive circuit (D1) for controlling expansion and contraction movement of the magneto striction elements (5,6) by changing a supply time period of a current supplied to the magneto striction elements (5,6). By controlling of the drive circuit (D1) the supply time period of the current which flows in the magneto striction elements (5,6) is changed to control the expansion and contraction movement of the elements (5,7). Thereby a horizontal vibration component can be eliminated and only vertical vibration component can be transmitted to the driven pile material (2).

21 Claims, 7 Drawing Sheets

FIG. 4(a) DRIVE PULSE Ip

FIG. 4(b) CURRENT Ic IN MAGNETIC STRICTION ELEMENT

FIG. 4(c) STRICTION OF CORE

TIME
$T_3$
TIME
$T_4$
FIG. 6(a) DRIVE PULSE Ip1
FIG. 6(b) CURRENT Ic1 IN MAGNETIC STRICTION ELEMENT
FIG. 6(c) STRICTION OF CORE 5a
FIG. 6(d) DRIVE PULSE Ip2
FIG. 6(e) CURRENT Ic2 IN MAGNETIC STRICTION ELEMENT
FIG. 6(f) STRICTION OF CORE 6a

VIBRATION EXCITER MACHINE

BACKGROUND OF THE INVENTION

1. Field of the Invention

The present invention relates to a vibration exciter machine used for driving a driven pile member to the ground or for pulling a driven pile member out of the ground, the driven pile member is an electrical light pole, a pile, a casing pipe, a sheet pile, and the like.

2. Description of the Prior Art

FIG. 1 shows a front view of a conventional vibratory hammer machine as a conventional vibration exciter machine, for example, which has been disclosed in Japanese Laid open Patent Application No. 47-15946.

In the drawing, a reference number 1 designates the main body of the conventional vibratory hummer, a reference numeral 2 denotes a driven pile member (a concrete pile) driven to the ground which supports the main body 1 of the vibratory hammer at the center portion thereof, and a reference number 3 designates the ground to which the driven pile member 2 (such as a concrete pile) is driven. In this case, this driven concrete pile member 2 is hang by a track crane in order to avoid that the driven concrete pile member 2 is fallen and in order to drive it to the ground 3.

The main body 1 of the conventional vibratory hammer comprises eccentric weights which are rotated in opposite directions to each other. By rotating the eccentric weights the vibratory hammer is vibrated towards upwards and downwards.

Next, the operation of the conventional vibratory hammer having the configuration described above will now be explained.

As described above, because the main body 1 of the conventional vibratory hammer is supported by the driven pile member 2, when the eccentric weights which constitute the main body 1 of the vibratory hammer are rotated, the vibratory hammer is vibrated toward up and down direction. This vibration of the vibratory hammer travels to the driven concrete pile 2. Thus, vibrating to upwards and downwards.

The driven pile member 2 is driven to the ground based on the self weight of the pile member 2 itself and the main body 1 of the vibratory hammer without generation of noise. Specifically, the driven pile member 2 is driven efficiently to the ground by utilizing a physical phenomenon that the dynamic friction of the ground becomes strictly small based on the vibration of the main body 1 of the vibratory hammer to upwards and downwards.

Because the conventional vibratory hammer has the configuration described above, a horizontal vibration component is also generated in addition to a vertical vibration component by rotating the eccentric weights. The horizontal vibration component is a component of the vibration of the vibratory hammer toward a horizontal direction. The vertical vibration component is a component of the vibration of the vibratory hammer toward a vertical direction. This horizontal vibration component causes a problem where the driven pile member 2 is driven toward undesired direction of the ground 3. In other words, by the horizontal vibration component of the vibration generated by the vibratory hammer, the driven pile member 2 can not be driven toward the vertical direction of the ground 3. In addition, the horizontal vibration component causes to increase the vibration of the ground 3 in a densely build-up area and causes a noise pollution. This is a problem.

SUMMARY OF THE INVENTION

The present invention has been made to solve the problem caused by the conventional vibratory hammer machine as described above.

It is an object of the present invention to provide a vibration exciter machine which can drive a driven pile member to the ground and pull the driven pile member out of the ground smoothly by causing efficiently only a vertical vibration component of the vibration of the vibration exciter machine without generating a horizontal vibration component which is injurious to the operation of the vibration exciter machine by utilizing a magneto striction element included in the vibration exciter machine.

In addition, in the vibration exciter machine of the present invention any required time period or width of the vibration of the vibration exciter machine itself can be set in order to avoid the generation of an abnormal resonant phenomenon.

It is a further object of the present invention to provide a vibration exciter machine having a plurality of magneto striction elements, which is capable of setting a required time period or width of the operation of each of the plurality of magneto striction elements so that the magnitude of the vibration of each of the plurality of magneto striction elements can be controlled. Thereby, a required driven direction for a driven pile member to the ground can be set with high precision.

It is a further object of the present invention to provide a vibration exciter machine to increase driving energy of a driven pile member such as a concrete pile based on a vibration.

Still another object of the present invention is to provide a vibration exciter machine comprising a magneto striction element of a negative magneto striction constant which is capable of efficiently executing a driving operation of a driven pile member to the ground.

A further object of the present invention is to provide a vibration exciter machine comprising a magneto striction element of a positive magneto striction constant which is capable of efficiently executing a driving operation of driven pile members to the ground.

Still another object of the present invention is to provide a vibration exciter machine comprising magneto striction elements which is capable of efficiently driving a driven pile member to the ground and pulling a driven pile member out of the ground by increasing a speed of expansion and contraction of the magneto striction elements.

A further object of the present invention is to provide a vibration exciter machine comprising a magneto striction element of a negative magneto striction constant and a positive magneto striction constant which can be used for driving operation to the ground and pulling out operation of the ground by setting a rising time period or width and a falling time period of currents which flows in coils of the magneto striction elements.

In accordance with a preferred embodiment of the present invention, there is a vibration exciter machine for driving a driven pile member to a ground or pulling the driven pile member out of the ground, comprising: magneto striction means for providing a vibration of up and down direction to said driven pile member; and a drive circuit for controlling expansion and contraction movement of said magneto striction means by changing a current supplied to said magneto striction means. Accordingly, by repeatedly supplying the switching current with a constant time width or a constant time period to the magneto striction means expansion and contraction drive forces can be generated and transmitted to a driven pile member through a pedestal so that the driven pile member is micro-vibrated towards up and down direction.

In the vibration exciter machine of the present invention, the drive circuit comprises a control circuit for adjusting a switching period of the current supplied to said magneto striction means. Thereby, by adjusting the switching period of the current provided to the magneto striction means, it can be selected to execute a drive operation to the ground with the most suitable switching time period according to the peripheral environment conditions, a hardness of the ground of the geology of a working area, and the like, and a driving speed for the driven pile member.

In addition, in the vibration exciter machine of the present invention, the magneto striction means comprises a plurality of magneto striction elements which are supported by said driven pile member, said drive circuit provides switching currents of different time widths to said plurality of magneto striction elements to each other, thereby each of said plurality of magneto striction elements is elongated and contracted independently. Thus, by expanding and contracting independently the plurality of magneto striction elements by using currents having different switching time widths, the magnitude of the vibration of the driven pile member can be adjusted with a required magnitude. Therefore a drive direction for the driven pile member to the ground can be selected at a desired angle, for example, to a vertical direction, or to a short incline angle to the vertical direction.

In addition, the vibration exciter machine of the present invention further comprises a weight, said weight is fixed on said magneto striction means or each of the plurality of magneto striction elements. Thus, when the vibration of the expansion and the contraction drive forces is transmitted to the weights, a great vibration load can be transmitted to the driven pile member to be driven to the ground.

In the vibration exciter machine of the present invention, the magneto striction means comprises a magneto striction material of a negative magneto striction constant as a core and a coil, said magneto striction means is contracted when the magnitude of said current provided from said control circuit to said coils is increased, and said magneto striction means is rapidly elongated to the original length of said magneto striction means when the current flow of said current provided from said control circuit to said coils is cut. For example, this negative magnetic striction material is a Nickel (Ni). Thus, the driven pile member can be riven to the ground by utilizing the force that is rapidly elongated to the original length of the magneto striction means after the magnetic striction means of the negative magnetic striction constant is contracted.

In the vibration exciter machine of the present invention, the magneto striction means comprises a magneto striction material of a positive magneto striction constant as a core and a coil, said magneto striction means is contracted when the magnitude of said current provided from said control circuit to said coils is increased, and said magneto striction means is rapidly contracted to the original length of said magneto striction means when the current flow of said current provided from said control circuit to said coils is cut. For example, this negative magnetic striction material is a Cobalt-Iron (Co-Fe). Thus, the driven pile member can be riven to the ground by utilizing the force that is rapidly contracted to the original length of the magneto striction means after the magnetic striction means of the negative magnetic striction constant is elongated.

In the vibration exciter machine of the present invention, the magneto striction means comprises a magneto striction material and a coil, and said drive circuit further comprises a series circuit having a diode and a resistance connected in series for damping a residual current in said coil when said current to be provided to coil is cut. Thus, by rapidly damping the residual current in the coils and rapidly executing expansion and contraction operations of the magneto striction means, the drive force and pull-out force for the driven pile member can be increased.

In the vibration exciter machine of the present invention, each of said switching currents having different rising time periods and different falling time periods to each other is provided to said coil. Thereby, the drive force to the ground and the pullout force of the ground can be selected appropriately by setting required rising time period and falling time period optionally.

In addition, the vibration exciter machine of the present invention, further comprises a pedestal, wherein said magneto striction means is fastened on said pedestal, said pedestal is supported by said driven pile member.

Furthermore, in the vibration exciter machine of the present invention, the magneto striction means is placed and fixed on said driven pile member. Accordingly, in this case, because the configuration of the vibration exciter machine is simple, it can be made with a low cost and used in a narrow working area.

These and other objects, features, aspects and advantages of the present invention will become more apparent from the following detailed description of the present invention when taken in conjunction with the accompanying drawings.

DESCRIPTION OF THE PREFERRED EMBODIMENTS

Preferred embodiments of the present invention will now be described with reference to the accompanying drawings.

FIRST EMBODIMENT

Figure 1:
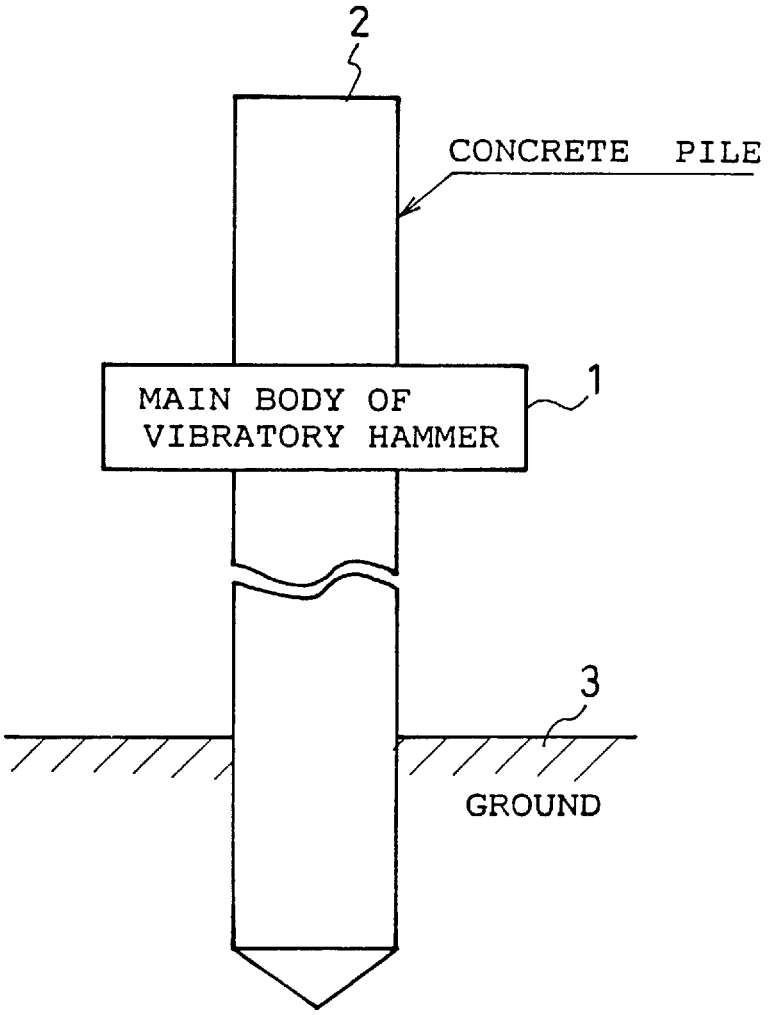
FIG.1 (PRIOR ART)
FIG. 1 shows a front view of a brief configuration diagram of a conventional vibration exciter machine (a vibratory hammer machine).
Figure 2A:
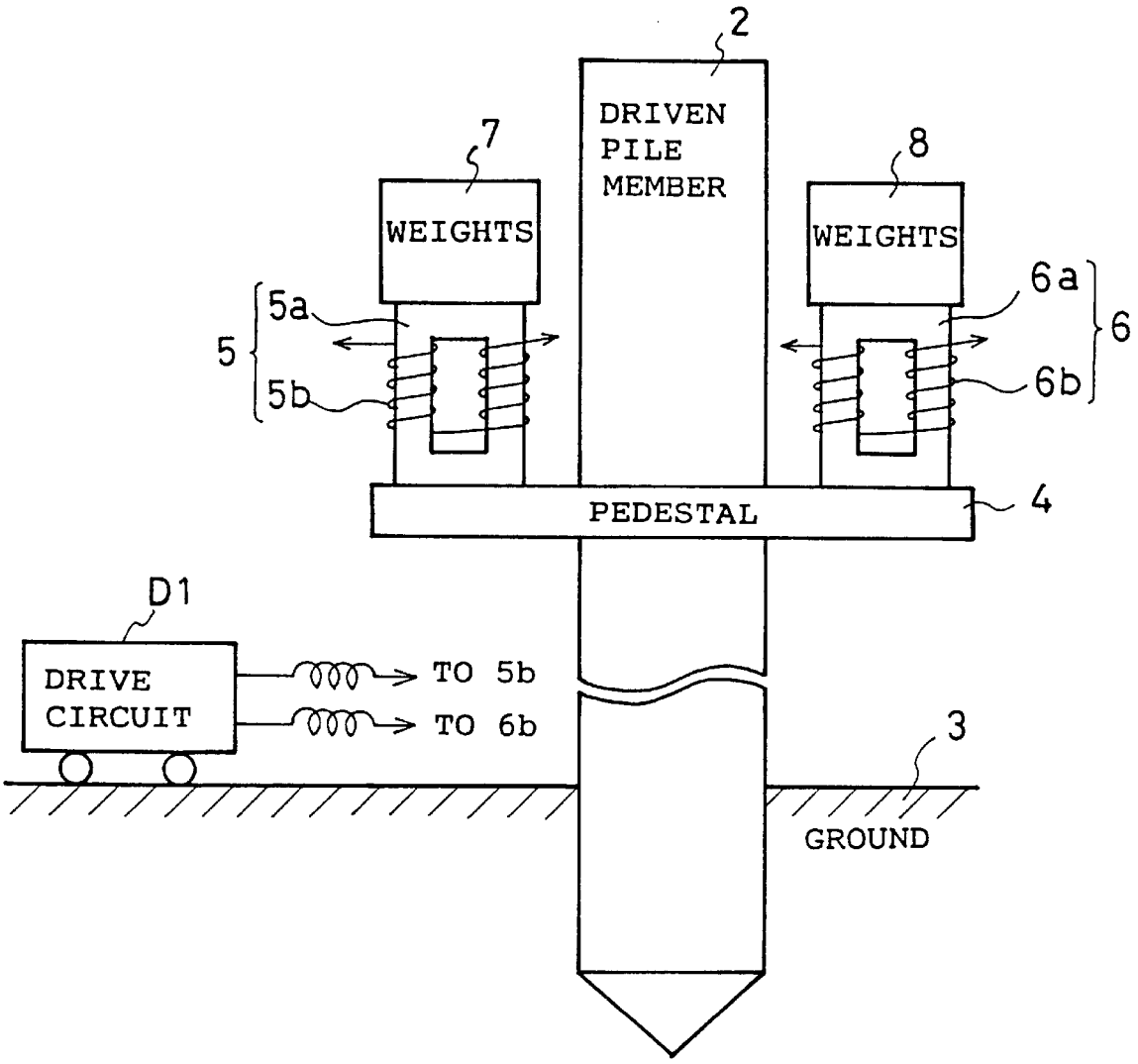
FIG. 2A is a front view showing a configuration of a vibration exciter machine as a preferred embodiment of the present invention.
Figure 2B:
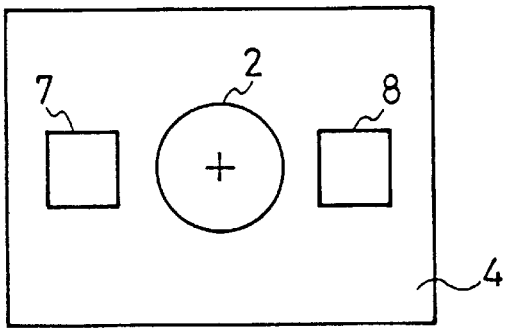
FIG. 2B is a plane view of the vibration exciter machine and a driven pile member as shown in FIG. 2A.

FIG. 2A is a front view showing a configuration of a vibration exciter machine as a first embodiment of the present invention. FIG. 2B is a plane view of the vibration exciter machine shown in FIG. 2A.

In FIG. 2A, a reference number 2 designates a driven pile member such as an electric light pole, a pile, a casing pipe, and a sheet pile to be driven to the ground 3. The driven pile member is supported by or pinched in an end portion of a wire or a chuck through a truck crane, for example.

A reference number 4 denotes a pedestal mounted in an upper portion or an intermediate portion of the driven pile member 2 to prevent falling it. On the pedestal 4 magneto striction elements 5 and 6 as magnetic striction means are placed around the driven pile member 2 which are one of the features of the present invention. The magneto striction elements 5 and 6 are fastened with bolts or adhesives on the pedestal 4, as shown in FIG. 2A.

These magneto striction elements 5 and 6 are placed so that a center of gravity of the vibration exciter machine and the driven pile member 2 becomes a center point of the driven pile member 2, designated by a character "+" in FIG. 2B. This is an important feature when the vibration exciter machine is sued and This is the same matter in another following embodiments of vibration exciter machine of the present invention. In addition, a shape of the pedestal 4 is not limited by a specific form. It can be selected according to applications, objects, working environments.

Weights 7 and 8 are placed and fastened or fixed on an upper portion of each of the magneto striction elements 5 and 6. These weights 6 and 7 are capable of changing expansion and contraction driving force generated by the magneto striction elements 5 and 6 to vibration load towards up and down direction and transmitting the changed vibration load to the driven pile member 2 to be driven to the ground 3.

The magneto striction elements 5 and 6 comprise cores 5*a* and 6*a* and coil 5*b* and 6*b*. The cores 5*a* and 5*b* comprise magneto striction material of a negative magneto striction constant such as a nickel (Ni) material, or a positive magneto striction constant such as a cobalt iron (Co-Fe) material.

The coil 5*b* and 6*b* are winded around the cores 5*a* and 6*a* of the magneto striction elements 5 and 6.

When a current flows through the coil 5*b* and 6*b*, the cores 5*a* and 6*a* which are made up of the positive magneto striction material such as the Co-Fe material, the magneto striction elements 5 and 6 are flexing along to the expansion direction and deformed.

On the other hand, when a current flows through the coil 5*b* and 6*b*, the cores 5*a* and 6*a* which are made up of the negative magneto striction material such as the Ni material, the magneto striction elements 5 and 6 are contracted along to the contraction direction and deformed.

Figure 3:
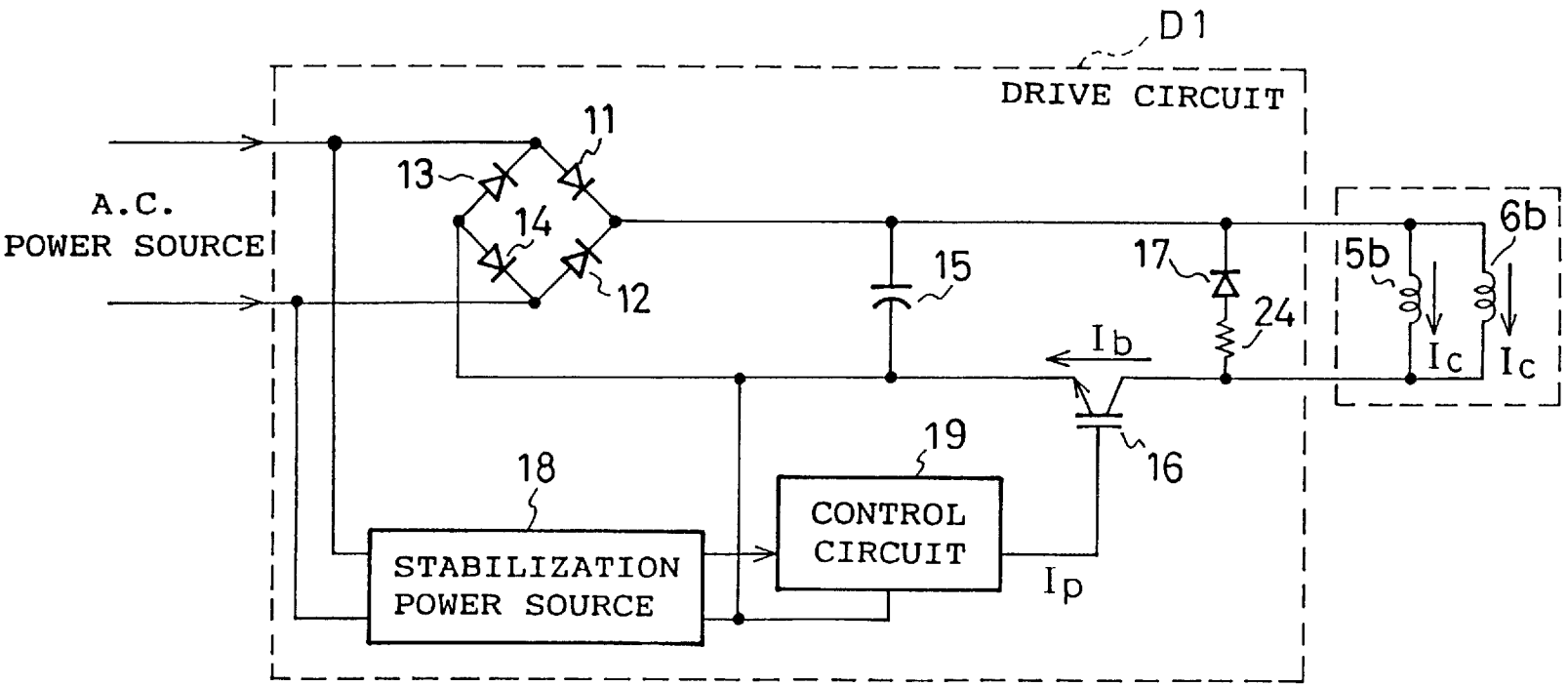
FIG. 3 is a configuration diagram of a drive circuit used for a magneto striction element which is one of configuration elements of the vibration exciter machine shown in FIG. 2.

FIG. 3 is a configuration diagram of a driver circuit D1 for the magneto striction elements 5 and 6. In the same drawing, reference numbers 11 to 14 designate diodes forming a full wave rectifier circuit, which are connected to an alternate current (A.C.) power source to rectify an alternate voltage.

In addition, a reference number 15 denotes a smoothing condenser connected to the full wave rectifier circuit, used for smoothing rectified alternate voltage.

Further, a reference number 16 designates an insulated gate bipolar transistor as a switching element which is incorporated in a circuit providing a direct current (D.C.) voltage smoothed by the smoothing condenser 15 to the coil 5*b* and 6*b* of the magneto striction elements 5 and 6.

A reference number 17 denotes a diode connected to a resistance 24 in series. The diode 17 and the resistance 24 forms a series circuit. These diode 17 and the resistance 24 forming the series circuit are connected to the coil 5*b* and 6*b* in parallel. These diode 17 and the resistance 24 are capable of removing residual current in the coil 5*b* and 6*b* when the insulated gate bipolar transistor 16 is OFF based on a control of the control circuit 19.

A reference number 18 designates a stabilization power source connected to the A.C. power source, and a reference number 19 denotes the control circuit for switching ON/OFF state of the insulated gate bipolar transistor 16 in the stabilization power source 18 as a power source.

Thus, the vibration exciter machine of the first embodiment comprises the magneto striction elements 5 and 6, the pedestal 4, the drive circuit 4, and weights 6 and 7.

Next, the operation of the vibration exciter machine of the first embodiment described above will be explained.

Figure 4:
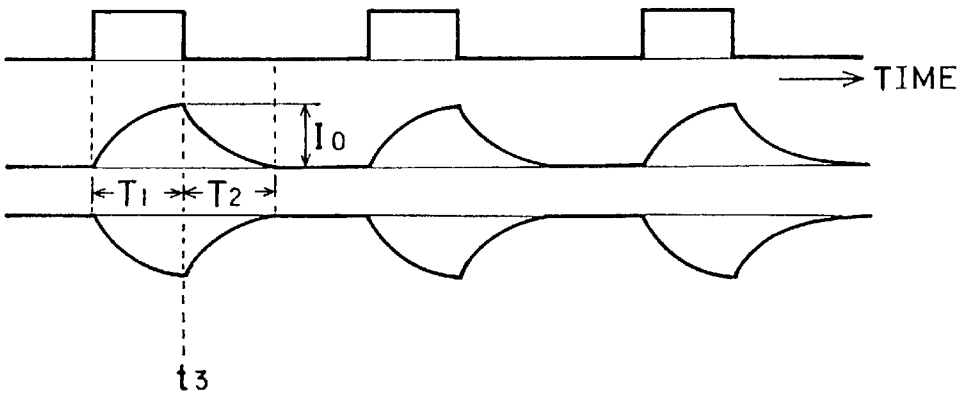
FIG. 4 is a timing chart showing signal waves of a drive pulse signal used for the drive circuit shown in FIG. 3, a current flowing in a coil of a magneto striction element, and a striction wave form signal of the magneto striction element.

First, when a voltage of the A.C. power supply is supplied to the full wave rectifier circuit 11–14 and the stabilization power source 18, the control circuit 19 receives the voltage of the stabilization power source, and generates a drive pulse Ip and transmits the drive pulse Ip to the insulated gate bipolar transistor 16. Specifically, the insulated gate bipolar transistor 16 of NPN type switch ON/OFF states (a switching operation) when the gate of the insulated gate bipolar transistor 16 receives the drive pulse transmitted from the drive circuit 19. During a desired time period of the ON state of the insulated gate bipolar transistor 16, a current, as shown in FIG. 4(*b*), flows in the coil 5*b* and 6*b* in the magneto striction elements 5 and 6. Therefore, each core 5*a* and 5*b* in which the current of a wave form shown in FIG. 4(*b*) flows receive a great electromagnet force toward upwards and downwards to distort like a wave form shown in FIG. 4(*c*).

Specifically, the magnitude of the magneto striction elements 5 and 6 or the intensity of the current is proportional to the magnitude of the striction of the magneto striction elements 5 and 6. When the Ni material of the negative magneto striction constant described above is used for the magneto striction elements 5 and 6, the magnitude of the current flow Ic in the coils 5*b* and 6*b* is increased during the ON state of the insulated gate bipolar transistor 16, namely the magneto striction elements 5 and 6 of the negative magneto striction constant are contracted toward the contraction direction.

On the other hand, at the moment, designated by the timing t3 shown in FIG. 4(*b*), that the insulated gate bipolar transistor 16 becomes OFF state from ON state, the magnitude of the current Ic in each the coil 5*b* and 6*b* becomes zero by the resistance 24. In other words, the length of the magneto striction material of the negative magneto striction constant in each cores 5*a* and 6*a* which is contracted while the insulated gate bipolar transistor is changed from ON state to OFF state, is rapidly elongated to the normal original length thereof. A restoring force of the magneto striction material becomes large based on the mechanical strength of the magneto striction material of the negative magneto striction constant. Specifically, by generating the restoring force periodically based on the contraction of the magneto striction material of the negative magneto striction constant, the driven pile member 2 such as a pile, a concrete pile is efficiently driven to the ground.

Next, when a magneto striction material of the positive magneto striction constant such as a Cobalt Iron (Co-Fe) material is used as the core member 5 and 6, because this magneto striction material is elongated in an electric magnetic field, it is elongated by increasing the magnitude of the current Ic flowing in the coil 5*b* and 6*b* through the insulated gate bipolar transistor 16, then the length of the magneto striction material can rapidly be contracted to the original length thereof by switching the insulated gate bipolar transistor 16 to OFF state from ON state instantaneously. Therefore, in this case, it can be efficiently used for pulling the driven pile member 2 such as a pile, a concrete pile out of the ground. In addition, the magnitude of the striction of the magneto striction material is determined by the combination of the intensity of the current Io shown in FIG. 4 flowing in the coil 5*b* and 6*b*, the rising time period or width T1 and the falling time period or width T2 of the current Ic, as shown in FIG. 4(*b*).

The rising time period or width T1 becomes T1=LIo/Eo Eo where L is an inductance of each coil 5*b* and 6*b*, and Eo is a voltage between the both ends of the condenser 15.

On the other hand, the falling time period or width T2 becomes T2=L/R where R is the magnitude of the resistance 24, because the falling time period T2 is the time required for changing the magnitude of the current Ic flowing in the coil 5*b* and 6*b* to zero when the insulated gate bipolar transistor is switched to OFF state.

Accordingly, either the conditions T1>>T2 or T1<<T2 can be selected by controlling the magnitude R of the resistance 24 and the magnitude E of the voltage. Specifically, when the magneto striction material of the negative magneto striction constant is used as the core member 5*a* and 6*a*, the condition T1>>T2 is selected, the smooth contraction operation and the rapid expansion operation of the magneto striction material can be achieved.

On the contrary, in the case of T1<<T2, the magnitude of the force for pulling a driven pile member out of the ground can be increased by the vibration exciter machine.

By transmitting the force momentarily generated by the magneto striction elements 5 and 6 to the driven pile member through the pedestal 4, and by adding the self-weight of the weights 7 and 8, the driven pile member 2 is driven into the ground 3 smoothly and slowly.

In this case, by designing the vibration exciter machine having each magneto striction element 5 and 6 with high accuracy a magneto striction element which is micro vibrated only toward the vertical direction, namely upwards and downwards, or up and down direction can be made. In addition, because the vibration operation of the weights 7 and 8 is also vibrated only toward the vertical direction which is same as the direction of the magneto striction element, if the position of each magneto striction element 5 and 6 and the weights 7 and 8 on the pedestal 4 is slightly shifted from a desired position, the magnitude of a horizontal vibration of the vibration exciter machine can be small and the vibration exciter machine of the present invention can give the force of the vertical direction to the driven pile material 2.

When an abnormal resonant phenomenon is happened between the magneto striction elements 5 and 6, or among the magneto striction elements 5 and 6, the weights 7 and 8, and the pedestal 4 during the expansion operation and the contraction operation of the magneto striction elements 5 and 6, there is a case that a desired vibration pattern according to the switch timing (the rising time period or width, and the falling time period or width prescribed above) of the insulated gate bipolar transistor 16 cannot be obtained, or that the vibration force added by the magneto striction elements 5 and 6 is rapidly and abnormally increased or decreased,. In addition, there is a case that a required frequency of the vibration toward the vertical direction may be selected based on a kind of the state of the ground to drive efficiently a driven pile member to the ground. In this case, changing the expansion and contraction drive timing (ON/OFF time period or width, or the rising time period or width, and the falling time period prescribed above) of the magneto striction elements 5 and 6 in order to shift the phase from the abnormal resonant point described above, namely changing the ON/OFF time period of the insulated gate bipolar transistor 16 will avoid the inconvenient phenomenon described above.

It is acceptable to set a switching frequency to expand and contract the magneto striction element at a high frequency within a frequency range of approximately 20 Hz to several 100 Hz, for example, by controlling externally with this control circuit 19. In addition, each magneto striction material has an inherent resonant frequency which is determined by the elastic coefficient, a phase, and a weight distribution thereof. Therefore it can be performed most efficiently to drive a driven pile member to the ground or to pull it out of the ground by expanding and contracting the magneto striction material with this inherent resonant frequency.

SECOND EMBODIMENT

Figure 5:
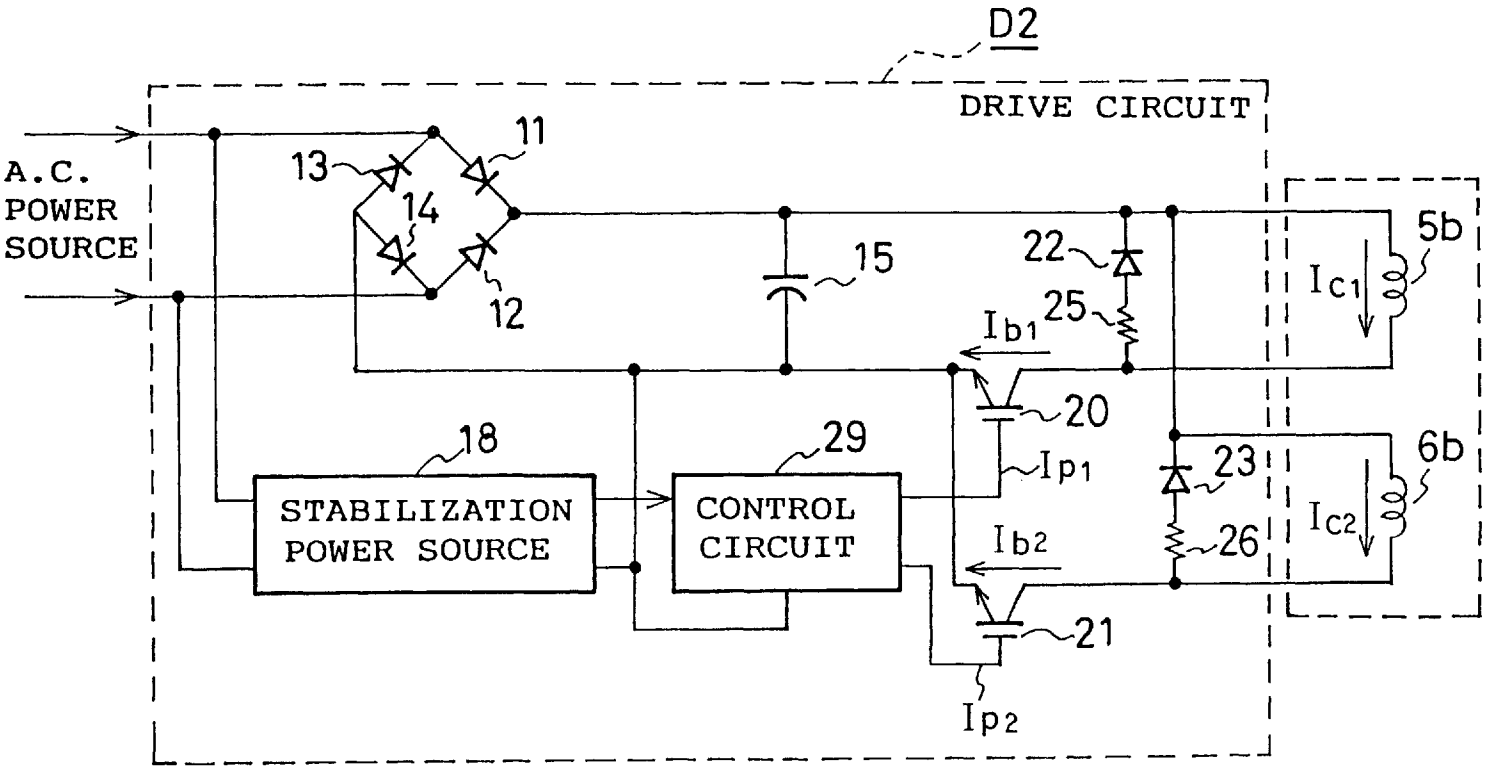
FIG. 5 is a configuration diagram of a drive circuit which is used for a magneto striction element and is one of configuration elements of a vibration exciter machine as another embodiment of the present invention.

FIG. 5 is a configuration diagram of a drive circuit D2 used for a vibration exciter machine of a second embodiment of the present invention. The vibration exciter machine of the second embodiment also comprises the pedestal 4, the drive circuit D2 shown in FIG. 5, magneto striction elements 5 and 6, and weights 6 and 7.

Figure 6:
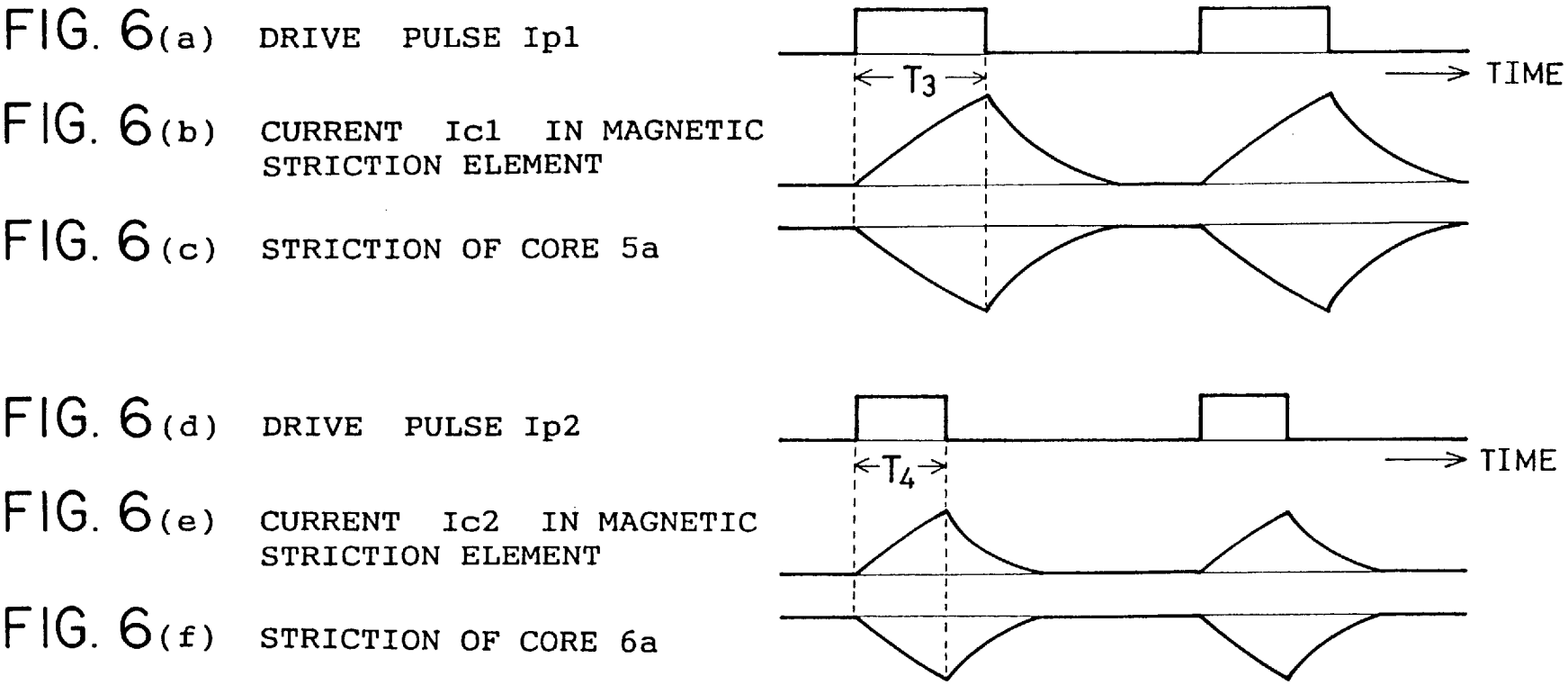
FIG. 6 is a timing chart showing signal wave forms of a drive pulse signal used for the drive circuit shown in FIG. 5, a current flowing in a coil of a magneto striction element, and a striction signal of the magneto striction element.

In the vibration exciter machine of the second embodiment, switching currents having different switching ON time widths (timing widths T3 and T4 as shown in FIG. 6) are supplied to coil 5*b* and 6*b* in the magneto striction elements 5 and 6, respectively. Specifically, as shown in FIG. 5, reference numbers 11 to 14 designate diodes forming a full wave rectifier circuit, which are connected to an alternate current (A.C.) power source to rectify an alternate voltage. A reference number 15 denotes a smoothing condenser connected to the full wave rectifier circuit 11–14, used for smoothing rectified alternate voltage. A reference number 18 designates a stabilization power source connected to the A.C. power source, the reference characters 5*b* and 6*b* indicate the coil of each of the magneto striction elements 5 and 6. These configuration elements 11–14, 15, 18, and 5*a* and 6*b* are same as that of the drive circuit D1 of the first embodiment shown in FIG. 3 in function and operation. The drive circuit 29 generates two kinds of switching control signals Ip1 and Ip2 which are different from each other in pulse width in response to external control signal.

Reference numbers 20 and 21 denote insulated gate bipolar transistors which are incorporated in a circuit for providing a direct current voltage which has been smoothed by the smoothing condenser 15 to the coils 5*b* and 6*b* separately. A reference number 22 is a diode connected to the resistance 25 in series. The diode 22 and the resistance 25 form a series circuit. A reference number 23 is a diode connected to the resistance 26 in series. The diode 23 and the resistance 26 also form a series circuit. Each series circuit including the diode and resistance is directly connected to each coil 5*b* and 6*b* in parallel and is capable of removing residual current in the coil 5*b* and 6*b* when the insulated gate bipolar transistor 20 and 21 become OFF.

In the drive circuit D2 in the second embodiment of the present invention, as shown in FIG. 6, the control circuit 29 receives a voltage from the stabilization power source 18 to generate drive pulses having predetermined switch ON time periods which are different to each other in time length, for example two kinds of drive pulses Ip1 of a pulse width T3 and Ip2 of a pulse width T4, as shown in FIGS. 6(*a*) and (*b*) and provided to each of the insulated gate bipolar transistors 20 and 21.

Thus, the insulated gate bipolar transistors 20 and 21 perform the switching operation by receiving these drive pulses Ip1 and Ip2. The currents Ic1 and Ic2, as shown in FIGS. 6(*b*) and (*e*) flow in the coils 5*b* and 6*b* in magneto striction elements 5 and 6, respectively, within the predetermined time widths T3 and T4 when the insulated gate bipolar transistors 20 and 21 are ON. Accordingly, each core 5*a* and 6*a* which is made up of magneto striction material 5 and 6 receives each current Ic1 and Ic2 which is different wave form to each other, and is elongated and contracted towards up and down direction and vibrates with a wave form, as shown in FIGS. 6(*c*) and (*f*).

In addition, each of the vibrations which are different in magnitude is transmitted to each weight 7 and 8 placed and fixed on each core 5*a* and 6*a*. The weights 7 and 8 are also vibrate like the core 5*a* and 6*a*. By this, a great vibration load is transmitted to the driven pile member 2 through the pedestal 4. This driven pile member 2 is driven to the ground 3 gradually.

In the vibration exciter machine of the second embodiment of the present invention, as shown in FIGS. 5 and 6, a driven angle to which the driven pile member 2 is driven to the ground 3 is modified and adjusted by selecting the magnitude of vibration of each of the magneto striction elements 5 and 6. Thereby, the driven pile member 2 can be driven vertically to the ground 3. Further, if required or necessary, a vibration of a horizontal direction can also be generated in order to incline a driven pile member towards a predetermined angle.

THIRD EMBODIMENT

Figure 7:
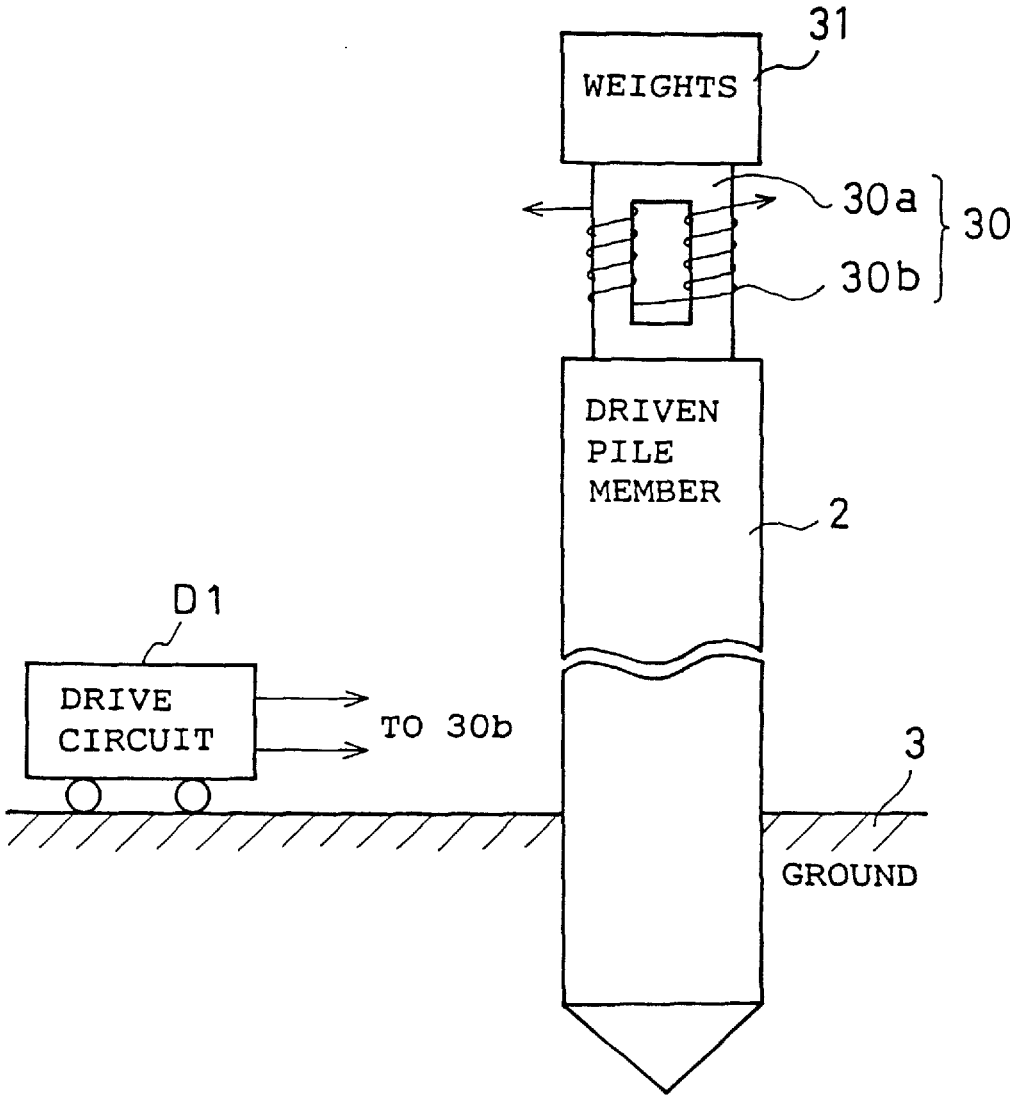
FIG. 7 is a front view of a configuration diagram of a vibration exciter machine as another embodiment of the present invention.

FIG. 7 is a configuration diagram of a vibration exciter machine as a third embodiment of the present invention.

In the third embodiment, the pedestal 4 shown in FIG. 2A is not required. A magneto striction element 30 comprising a core 30*a* and a coil 30*b*, and a weight 31 are placed and fastened on a head portion of a driven pile member 2 in the vibration exciter machine of the third embodiment.

A drive circuit used for the vibration exciter machine of this embodiment has a configuration of the drive circuit D1 shown in FIG. 3 of the second embodiment where either of the coils 5*b* and 6*b* is not necessary. The operation of the drive circuit of this embodiment is same as that of the embodiment shown in FIGS. 3 and 4.

The vibration exciter machine of the embodiment shown in FIG. 7 can be efficiently used for cases where there is no adequate working area for driving a driven pile member 2 to the ground 3, or there is adjacent driven pile members which are closed together. Further the vibration exciter machine shown in FIG. 7 has the advantage that the configuration thereof is a simple and will be made at low manufacture cost.

This invention is not limited by the above described embodiments shown in FIGS. 2–7, for example an insulated gate bipolar transistor of PNP conductivity type can be used instead of the insulated gate bipolar transistor of NPN conductivity type. In addition, the insulated gate bipolar transistor of PNP conductivity type has the same function and effect of the insulated gate bipolar transistor of NPN conductivity type.

In summary, as described above in detail, because the vibration exciter machine of the present invention is supported by a driven pile member and includes magneto striction elements for generating vibration toward up and down direction or the vertical direction of the driven pile member and providing this vibration to the driven pile member, and also includes a drive circuit to expand and contract the magneto striction elements by switching the current flow timing period of a current supplied to the magneto striction elements, it can be achieved to eliminate a vibration component of a horizontal direction which is detrimental to operation, and during efficiently generating only the vertical component of the vibration, the drive operation and pull-out operation of the driven pile member to the ground can be smoothly executed.

In addition, by using the vibration exciter machine of the present invention, because the drive circuit comprises a control circuit for adjusting a switching time period of a current provided to the magneto striction elements, it can be avoid to cause an abnormal resonant phenomenon generated among the magneto striction elements, weights, and a pedestal by changing the switching time period of the current. In addition, it can be selected to execute a drive operation to the ground with the most suitable switching time period according to the geology of a working area.

Moreover, by using the vibration exciter machine of the present invention, a plurality of magneto striction elements are provided to the driven pile member and the expansion and contraction vibration operation of each magneto striction element is controlled by changing the switching time period of a current flowing in each magneto striction element, independently, the magnitude of the vibration generated at each magneto striction element can be selected with a required magnitude. Because a vibration force applied to each part of a driven pile member can be changed, the driven pile member can be driven to the ground with a desired direction.

Furthermore, by using the vibration exciter machine of the present invention, because a weight is fixed on each of magneto striction elements, the driving energy for a driven pile member such as a concrete pile based on a vibration generated by the magneto striction element can be increased in magnitude.

In addition, because a magneto striction element of a negative magneto striction constant is used as a core of the vibration exciter machine of the present invention where the magneto striction element is contracted when the magnitude of a current flow is increased and rapidly elongated to the original length of the magneto striction element when the current flow is cut, the drive operation for the driven pile member can be performed efficiently.

Furthermore, because a magneto striction element of a positive magneto striction constant is used as a core of the vibration exciter machine of the present invention where the length of the magneto striction element is elongated when the magnitude of a current flow is increased and rapidly contracted to the original length of the magneto striction element when the current flow is cut, the drive operation for the driven pile member can be executed efficiently.

Furthermore, in the vibration exciter machine of the present invention, a circuit comprising a diode and a resistance connected in series in order to reduce residual current in the coil when a current supplied to each coil is cut is connected to each coil which is made up of each magneto striction element in parallel, the expansion and contraction operation speed of the magneto striction element can be increased and the magnitude of the drive force and pull-out force for the driven pile member can also be increased.

Furthermore, in the vibration exciter machine of the present invention, because either of a rising time length and a falling time length of a current flowing in a coil forming a magneto striction element is longer and the rising time length and the falling time length can be set as desired time lengths, both magneto striction materials of a negative and positive magneto striction constants can be used for magneto striction elements applicable to a drive operation to the ground and pull-out operation of the ground.

Although the present invention has been described and illustrated in detail, it is clearly understood that the same is by way of illustration and example only and is not to be taken by way of limitation, the spirit and scope of the present invention being limited only by the term of the appended claims.

It should be apparent to those skilled in the art that many changes can be made in the detailed and arrangements of the steps and parts without departing from the scope of the invention as defined in the appended claims.

What is claimed is:

1. A vibration exciter machine for driving a driven pile member to a ground or pulling the driven pile member out of the ground, comprising:

magneto striction means for providing a vibration of up and down direction to said driven pile member; and a drive circuit for controlling expansion and contraction movement of said magneto striction means by changing a current supplied to said magneto striction means.

2. A vibration exciter machine as claimed in claim 1, wherein said drive circuit comprises a control circuit for adjusting a switching period of the current supplied to said magneto striction means.

3. A vibration exciter machine as claimed in claim 2, said magneto striction means comprises a magneto striction material and a coil, and said drive circuit further comprises a series circuit having a diode and a resistance connected in series for damping a residual current in said coil when said current to be provided to coil is cut.

4. A vibration exciter machine as claimed in claim 1, wherein said magneto striction means comprises a plurality of magneto striction elements which are supported by said driven pile member, said drive circuit provides switching currents of different time widths to said plurality of magneto striction elements to each other, thereby each of said plurality of magneto striction elements is elongated and contracted independently.

5. A vibration exciter machine as claimed in claim 4, further comprises a plurality of weights, each of said weights is fixed on each of said plurality of magneto striction elements.

6. A vibration exciter machine as claimed in claim 5, further comprises a pedestal, wherein said plurality of magneto striction elements are fastened on said pedestal, said pedestal is supported by said driven pile member.

7. A vibration exciter machine as claimed in claim 4, each of said plurality of magneto striction elements comprises a magneto striction material and a coil, and said drive circuit further comprises a series circuit having a diode and a resistance connected in series for damping a residual current in said coil when said current to be provided to coil is cut.

8. A vibration exciter machine as claimed in claim 7, wherein each of said switching currents having different rising time periods and different falling time periods to each other is provided to each of said plurality of coils.

9. A vibration exciter machine as claimed in claim 4, wherein each of said plurality of magneto striction means comprises a magneto striction element and a coil, each of a plurality of switching currents having different rising time periods and different falling time periods to each other is provided to said coil.

10. A vibration exciter machine as claimed in claim 1, wherein further comprises a weight, said weight is fixed on said magneto striction means.

11. A vibration exciter machine as claimed in claim 10, wherein saidmagnetoo striction means comprises a magneto strictionmateriall of a negative magneto striction constant as a core and a coil, said magneto striction means is contracted when the magnitude of said current provided from said control circuit to said coils is increased, and said magneto striction means is rapidly elongated to the original length of said magneto striction means when the current flow of said current provided from said control circuit to said coils is cut.

12. A vibration exciter machine as claimed in claim 11, wherein each of said switching currents having different rising time periods and different falling time periods to each other is provided to said coil.

13. A vibration exciter machine as claimed in claim 10, wherein said magneto striction means comprises a magneto striction material of a positive magneto striction constant as a core and a coil, said magneto striction means is elongated when the magnitude of said current provided from said control circuit to said coils is increased, and said magneto striction means is rapidly contracted to the original length of said magneto striction means when the current flow of said current provided by said control circuit to said coils is cut.

14. A vibration exciter machine as claimed in claim 10, further comprises a pedestal, wherein said magneto striction means is fastened on said pedestal, said pedestal is supported by said driven pile member.

15. A vibration exciter machine as claimed in claim 10, wherein said magneto striction means is placed and fixed on said driven pile member.

16. A vibration exciter machine as claimed in claim 1, wherein saidmagnetoo striction means comprises a magneto strictionmateriall of a negative magneto striction constant as a core and a coil, said magneto striction means is contracted when the magnitude of said current provided from said control circuit to said coils is increased, and said magneto striction means is rapidly elongated to the original length of said magneto striction means when the current flow of said current provided from said control circuit to said coils is cut.

17. A vibration exciter machine as claimed in claim 16, wherein said magneto striction material of the negative magneto striction constant is a magneto striction material mainly including a Nickel (Ni).

18. A vibration exciter machine as claimed in claim 1, wherein saidmagnetoo striction means comprises a magneto strictionmateriall of a positive magneto striction constant as a core and a coil, said magneto striction means is elongated when the magnitude of said current provided from said control circuit to said coils is increased, and said magneto striction means is rapidly contracted to the original length of said magneto striction means when the current flow of said current provided from said control circuit to said coils is cut.

19. A vibration exciter machine as claimed in claim 18, wherein said magneto striction material of the positive magneto striction constant is a magneto striction material mainly including a Cobalt-Iron (Co-Fe).

20. A vibration exciter machine as claimed in claim 1, said magneto striction means comprises a magneto striction material and a coil, and said drive circuit further comprises a series circuit having a diode and a resistance connected in series for damping a residual current in said coil when said current to be provided to coil is cut.

21. A vibration exciter machine as claimed in claim 1, further comprises a pedestal, wherein said magneto striction means is hastened on said pedestal, said pedestal is supported by said driven pile member.

* * * * *